US009236176B2

(12) United States Patent
Sugita

(10) Patent No.: US 9,236,176 B2
(45) Date of Patent: Jan. 12, 2016

(54) SEPTUM MAGNET

(75) Inventor: Kei Sugita, Darmstadt (DE)

(73) Assignee: GSI HELMHOLTZZENTRUM FUER SCHWERIONENFORSCHUNG GMBH, Darmstadt (DE)

( * ) Notice: Subject to any disclaimer, the term of this patent is extended or adjusted under 35 U.S.C. 154(b) by 0 days.

(21) Appl. No.: 14/342,820

(22) PCT Filed: Aug. 30, 2012

(86) PCT No.: PCT/EP2012/066841

§ 371 (c)(1),
(2), (4) Date: Mar. 5, 2014

(87) PCT Pub. No.: WO2013/034481

PCT Pub. Date: Mar. 14, 2013

(65) Prior Publication Data

US 2014/0232497 A1 Aug. 21, 2014

(30) Foreign Application Priority Data

Sep. 6, 2011 (EP) ..... 11180286

(51) Int. Cl.

| | |
|---|---|
| ***H01F 7/20*** | (2006.01) |
| ***H05H 7/04*** | (2006.01) |
| ***H05H 7/08*** | (2006.01) |
| ***H05H 7/10*** | (2006.01) |

(52) U.S. Cl.

CPC ..... *H01F 7/202* (2013.01); *H05H 7/04* (2013.01); *H05H 7/08* (2013.01); *H05H 7/10* (2013.01); *H05H 2007/046* (2013.01)

(58) Field of Classification Search

CPC ..... H01F 7/202; H05H 2007/002; H05H 2007/045–2007/048; H05H 2007/087; H05H 7/10; H05H 2007/04–2007/08

See application file for complete search history.

(56) References Cited

U.S. PATENT DOCUMENTS

| | | | | |
|---|---|---|---|---|
| 2,692,355 | A * | 10/1954 | Sickles et al. | 335/213 |
| 2,824,267 | A * | 2/1958 | Barkow | 335/213 |
| 4,153,889 | A | 5/1979 | Ikegami | |
| 4,939,493 | A | 7/1990 | Krienin | |
| 5,073,913 | A | 12/1991 | Martin | |

OTHER PUBLICATIONS

Balhan, et al, "The Septum Magnet System of New Fast Extraction Channel of the SPS at CERN", IEEE Transactions on Applied Superconductivity, vol. 14, No. 2, Jun. 2004, pp. 429-432.

Krienen, et al., "The Truncated Double Cosine Theta Superconducting Septum Magnet", Nuclear Instruments and Methods in Physics Research A283 (1989), May 1989, pp. 5-12.

Yamamoto, et al, "The superconducting inflector for the BNL g-2 experiment", Nuclear Instruments and Methods in Physics Research A 491, May 2002, pp. 23-40, Elsevier.

* cited by examiner

*Primary Examiner* — Ramon M Barrera

(74) *Attorney, Agent, or Firm* — Leydig, Voit & Mayer, Ltd.

(57) ABSTRACT

A device for generating a magnetic field includes at least one electric coil having electric conductors that are arranged along a circular arc within a first angular range and that deviate from the circular arc within a second angular range. At least one magnetic yoke is arranged along a part of the first angular range.

21 Claims, 7 Drawing Sheets

SEPTUM MAGNET

CROSS REFERENCE TO RELATED APPLICATIONS

This application is a U.S. National Phase application under 35 U.S.C. §371 of International Application No. PCT/EP2012/066841 (WO 2013/034481 A1), filed on Aug. 30, 2012, and claims benefit to European Patent Application No. EP 11180286.4, filed Sep. 6, 2011.

FIELD

The invention relates to a magnetic field generating device, comprising at least one electric coil device with electric conductors and at least one magnetic yoke device. The invention further relates to a magnetic switch arrangement for particle beam accelerators.

BACKGROUND

Nowadays, highly energetic charged particles are used for a wide variety of purposes. While in the beginning highly energetic charged particles were only used in scientific experiments, they are meanwhile used in: industry and medicine. As an example, highly energetic charged particles are used for surface hardening or the implantation of impurities into semiconductors. For medical applications, the treatment of cancer by highly energetic charged particles plays an increasingly important role.

As charged particles, in principle all types of charged particles can be used. In particular, leptons (electrons, positrons), hadronic particles (protons, helium cores, heavy ions, mesons, anti-protons) have to be mentioned. If the energies to be obtained (i.e. the speed of the particles) are comparatively low, usually linear accelerators are used. However, if the energies to be obtained are higher, linear accelerators would become too long and hence too expensive to reach such high energy levels. Therefore, as an alternative, circular accelerators (so-called synchrotrons) are used for accelerating (and even for storing) charged particles to very high energy levels.

If circular accelerators are used, the problem of how to introduce (inject) and to extract the particles into and out of the circular accelerator arises.

For performing this task, special (particle) switches are used. Typically, a combination of a so-called kicker magnet and a septum magnet is used. The kicker magnet is an extremely fast switching electromagnet (switching time typically in the order of 0.1 microseconds) that is selectively "distorting" the path of the particle beam. If the kicker magnet is switched off (undistorted path), the particle beam flies straight forward and continues to circle within the circular accelerator. If the kicker magnet is switched on, however, the particle beam is kicked sideward (hence the name kicker magnet) by a couple of centimeters. To further separate the two possible particle tracks, a so called septum magnet is used (which shows an essentially static magnetic field). The septum magnet is designed in a way that a first cavity is provided, in which a strong magnetic field (in the order of around 1 Tesla) is present while in a second cavity no or only a very small magnetic field is present. Depending on the "kicking distance" of the kicker magnet, the two cavities are typically separated by only a couple of centimeters. It, is easily understandable, that this is a difficult task to accomplish.

The standard design for septum magnets is an electric coil with a C-shaped iron yoke, wherein the gap in the C-shaped iron yoke is forming the area, in which the magnetic field is applied to the charged particle beam.

Other possible designs for septum magnets are described in the U.S. Pat. No. 4,939,493 and in the scientific publications "The Truncated Double Cosine Theta Superconducting Septum Magnet" by F. Krienen, D. Loomba and W. Meng, Nuclear Instruments and Methods in Physics Research A 283 (1989), pages 5-12 and in "The Superconducting Inflector for the BNL g-2 Experiment" by A. Yamamoto et al, in Nuclear Instruments and Methods in Physics Research A 491 (2002), pages 23-40.

SUMMARY

In an embodiment, the present invention provides a device for generating a magnetic field comprising at least one electric coil including electric conductors arranged along a circular arc within a first angular range and deviating from the circular arc within a second angular range. At least one magnetic yoke is arranged along a part of the first angular range.

BRIEF DESCRIPTION OF THE DRAWINGS

The present invention will be described in even greater detail below based on the exemplary figures. The invention is not limited to the exemplary embodiments. All features described and/or illustrated herein can be used alone or combined in different combinations in embodiments of the invention. The features and advantages of various embodiments of the present invention will become apparent by reading the following detailed description with reference to the attached drawings which illustrate the following.

DETAILED DESCRIPTION

Figure 1:
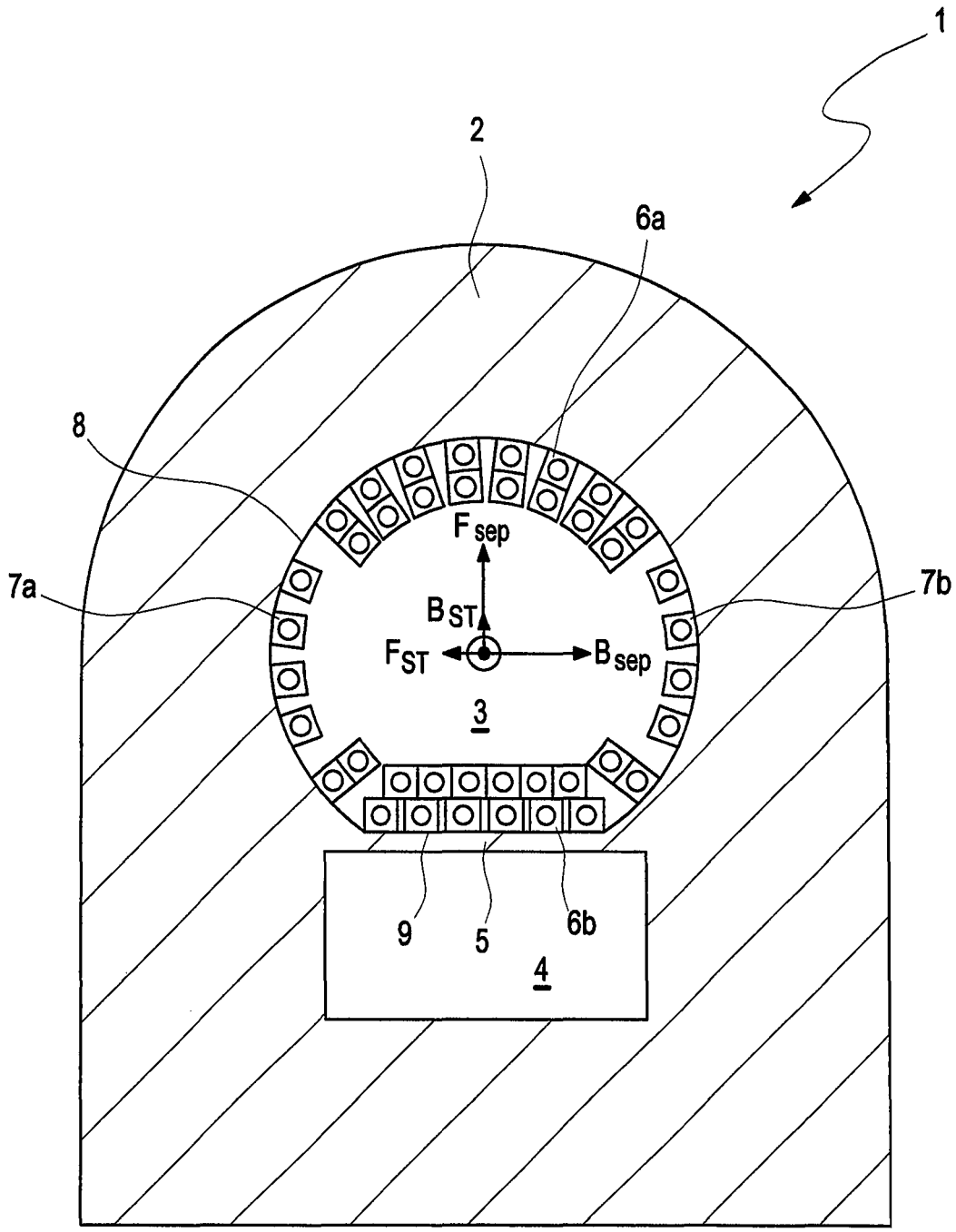
FIG. 1 shows a first embodiment of a septum magnet in a schematic cross-section.

Presently existing septum magnets still show deficiencies.

In an embodiment, the invention provides a magnetic field generating device that is particularly useful as a septum magnet.

In an embodiment, the invention provides a magnetic field generating device that comprises at least one electric coil device in a way that in at least one cross-section of said electric coil device the electric conductors are arranged essentially along a circular arc within at least a first angular range and are deviating from said circular arc within at least a second angular range, and wherein at least one magnetic yoke device is arranged at least along a part of said first angular range. The inventors found that using such a magnetic field generating device, it is possible to generate a highly inhomogeneous magnetic field that is advantageous for use as a septum magnet. In particular, it is possible to generate a magnetic field that is very strong (and comparatively homogeneous) in a certain finite-sized area within the cross-sectional plane (typically in the order of several square centimeters), while it is very small (and comparatively homogeneous) in another finite areas within the cross-sectional plane (also typically in the order of at least several square centimeters) of said magnetic field generating device. Of course, larger and smaller areas are possible for the strong magnetic field section and/or the small magnetic field section. Such a distribution of the resulting magnetic field is highly advantageous for using the magnetic field generating device as a septum magnet. However, different uses of such a magnetic field generating device are also possible and are of course envisaged by the present application. The individual conductors of at least one electric coil device can be arranged neighboring each other and/or with a certain spacing in between. Of course, this can change along the circumference of the electric coil device. In particular, the distance of the spacing between two individual conductors can vary as well. In particular, the electric conductors of at least one electric coil device can be arranged at essentially any angle with respect to the longitudinal axis of at least one electric coil device (furthermore, the angle can differ between at least some of the electric conductors). It is possible that a part or all of the electric conductors are connected in series (which is actually the usually used standard design), so that they are supplied with electric energy by the same power supply. However, it is also possible that the electric conductors are grouped in this respect, so that different groups are connected in series to each other, such that the individual groups are supplied by an individual power supply, respectively. In extreme case, it is also possible that essentially every individual conductor has its own power supply. Of course, at least part of the conductors can be arranged in parallel as well. It should be mentioned, that the wiring pattern of the conductors (conductor groups) can be at least in part the same and/or different. In particular, some of the conductors can be wired according to a magnetic dipole, while other conductors can be wired according to a magnetic quadrupole and so on. Of course, the wiring pattern of at least some of the conductors/electric coils can be essentially or at least in principle the same. The suggested layout in form of a circular arc within at least a first angular range and a layout, deviating from a circular arc within at least a second angular range can be considered to be somewhat of an "indented circle" or a "truncated circle". The indentation of the circle can be of essentially any kind. In particular it can be a straight line (which is slightly convex or slightly concave) or can be a "real" convex or concave form that is following any kind of curve (hysteresis, circle, ellipses and so on). In particular, some "matching curves" or "smoothing curves" between the "truncated part" and the "circle part" of the electric coil can be foreseen as well. Preferably, apart from said electric conductors in the first angular range and in the second angular range, essentially no additional conductors are arranged in and/or in the vicinity of the magnetic field generating device. By the term "essentially no additional conductors" it is meant that it is of course possible to use some electric conductors serving a different purpose and/or generating only a minor part of the overall magnetic field. As an example, electric conductors that are used for supplying detectors or electric pumps with electricity and/or that are used for transmitting sensor data (and so on) are generally not "additional conductors" in the sense of this document. However, it is even possible that electric conductors that are used for generating and/or for influencing and/or for adjusting a magnetic field are not to be considered as "additional conductors", as long as they generate only a small part of the overall magnetic field (for example less than 10%, 9%, 8%, 7%, 6%, 5%, 4%, 3%, 2%, 1% or 0.5%) and/or as long as they generate a magnetic field only for a short time fraction (for example for less than 33.3%, 30%, 25%, 20%, 15%, 10%, 9%, 8%, 7%, 6%, 5%, 4%, 3%, 2%, 1% or 0.5% of the time). An example for such an electric conductor would be a small coil for smoothing the overall magnetic field and/or for smoothing a magnetic stray field or the like or a kicker magnet (to be more exact the electric conductors of a kicker magnet). By using the suggested magnetic yoke device it is not only possible to improve the resulting magnetic field, but also to improve the quality of the magnetic field (i.e. the "binary" field pattern comprising a strong magnetic field area and a low magnetic field area). Due to this magnetic yoke, it is also possible that the electric current that has to be provided can be considerably lower, so that energy can be conserved. The magnetic yoke device can be essentially of any form and does not necessarily have to be closed. Nevertheless, the magnetic yoke device is beneficiary, even in an "open" form. Another significant advantage of the presently proposed magnetic field generating device is that it normally does not need an external magnetic field for being functional. Instead, the magnetic field generating device according to the present suggestion can provide a septum functionality on its own (as some kind of a "stand-alone" septum device). This can save energy and expenses. Nevertheless, it is still possible that the magnetic field generating device is used within external magnetic fields as well. This way, the presently-suggested magnetic field generating device can be used as a "drop in"-solution. Typically, a significant fraction (preferably the majority, essentially or even all) of the "relevant" electric conductors is (are) arranged inside the magnetic yoke. This way, usually a better magnetic field can be obtained (for example a more homogeneous magnetic field).

Preferably, the magnetic field generating device is designed in a way that said at least one magnetic yoke device is arranged at least along essentially the whole first angular range and/or in a way that said magnetic yoke device forms a closed magnetic field device. By such an embodiment of the magnetic field generating device the quality and strength of the resulting magnetic field distribution can usually be improved. By an improvement of the strength of the magnetic field, in particular an improvement in the strength of the magnetic field in the finite sized area of high magnetic field strength is usually meant. Those effects, i.e. a better magnetic field distribution and a stronger magnetic field in the strong magnetic field area are particularly advantageous for use of the magnetic field generating device as a septum magnet. Nevertheless, the magnetic field generating device can be of use, even if the magnetic yoke device is smaller as the first angular range and/or is not closed.

Preferably, the magnetic field generating device is designed in a way that the magnetic yoke device comprises at least two channel sections, wherein preferably at least a first channel section is arranged inside of said at least one electric coil device and at least a second channel section is arranged outside of said at least one electric coil device, and wherein preferably said at least two channel sections are at least partially separated by a magnetic yoke wall, lying between said first channel section and said second channel section. In particular, a first channel section can be used for the extracted/injected particle beam, while the second channel section can be used for the circulating particle beam or vice versa. The channel sections can be either designed in a way that they can be evacuated and/or that they can contain an evacuated tube (pipe/beam line etc) Their evacuation level is particularly on a high vacuum level, an ultra-high vacuum level and/or an extra high vacuum level. Such vacuum levels are essential if charged particle beams have to be guided through the magnetic field generating device. While it is possible that the magnetic yoke wall separating the channel sections is of a considerable size, first experiments have shown that the advantageous magnetic field distribution pattern can be even realized, if the magnetic yoke wall is comparatively thin, like 1 cm or the like. In principle, the magnetic yoke device can be of any thickness. Usually, for getting improved results, the thickness of the magnetic yoke device should be in the order of 5, 8, 10, 15 or 20 cm, at least in certain parts. Of course, it is possible that the thickness of the magnetic yoke device varies (in particular in the case of a closed magnetic yoke device).

In principle, the magnetic yoke device can be made and/or can contain essentially every material. However, a particularly advantageous embodiment of the magnetic field generating device can be realized if said magnetic yoke device comprises at least in part ferromagnetic material, in particular iron and/or steel and/or if said magnetic yoke device is designed at least in part comprising stacked sheet layers. First experiments have shown that when using the suggested material, particularly strong magnetic fields can be realized with relatively low power consumption and at comparatively low cost. In particular, when using stacked sheet layers, a change of the magnetic field strength can usually be performed faster, because typically eddy currents in the magnetic yoke material can be suppressed or even essentially avoided.

According to a preferred embodiment of the magnetic field generating device, said at least one electric coil device is a tubular electric coil device, preferably an elongated tubular electric coil device and/or said cross-section of the at least one electric coil device lies essentially perpendicular to the longitudinal axis of that at least one electric coil device. This way, a very effective and efficient design that is even usually lower in costs can be realized. In particular, if an (elongated) tubular design of the electric coil is used, the "continuous" force, acting on the charged particles of the charged particle beam can "sum up", so that a considerable bending angle can be realized without unduly high magnetic field strengths. It should be noted that by a large curvature diameter, synchrotron radiation (and therefore energy losses of the particles) can be lowered, which is usually advantageous.

Preferably, the magnetic field generating device is designed in a way that it leaves a part of the conductors is tilted with respect to the cross-sectional plane and/or with respect to the main axis of the at least one electric coil device and if at least a part of the conductors is preferably arranged as cosine theta magnet windings and/or cosine n-times theta magnet windings (in particular where n=2, 3, 4, 5, 6, 7, 8, 9 or 10). This layout of the conductors (which is known from the state of the art as such with respect to electric coil designs) has proven to be advantageous with respect to the presently suggested magnetic field generating device as well.

Furthermore, it is preferred if in the magnetic field generating device, the electric conductors within said second angular range are arranged along an essentially straight line and/or are arranged along a curved line that is preferably pointing to the inside of said circular arc. Such a design has proven to be particularly advantageous, although for certain applications other designs can be beneficial as well. In particular, the curved line can be (a part) of a circle, an ellipsis, a hyperbola, a parabola or the like. In particular, "smoothing" curves ("matching" curves) can be used, in particular in the vicinity between the connecting point between said at least one circular arc and said at least one pair that is deviating from the circular arc (i.e. the "truncation part").

Usually, it is preferred if a curved line is indented towards the inside of the "truncated" circular arc. However, under certain circumstances, a different design might prove to be useful as well.

According to another preferred embodiment of the presently suggested magnetic field generating device, the electric conductors of at least one group of electric conductors within said at least one second angular range are arranged along the magnetic field line(s) that would be obtained if all of the electric conductors of at least this group would be arranged along at least one essentially full circle line. This statement can particularly relate to individual groups of a plurality of groups of electric conductors. !he "grouping" can be done both with respect to electric power supply and/or functionality. In particular, this can relate to the steerer part and/or the septum part and/or the dipole part and/or the quadrupole part of a magnetic field generating device. Theoretical calculations and first experiments have shown that when placing electric conductors along such a (curved/straight/otherwise shaped) line, the strength and in particular the quality of the resulting magnetic field can be improved usually significantly. Of course, the electric conductors "outside" of the "truncation line" usually have to be "removed" after this calculation ('thought experiment').

Usually, another preferred embodiment of the magnetic field generating device can be achieved if the electric conductors are arranged in groups that are preferably slightly spaced from each other. First experiments have shown that a higher "density" of conductors in certain areas can improve the resulting magnetic field of the magnetic field•generating device and/or can lower cost and/or power consumption without a significant deterioration of the resulting magnetic field. Therefore, in the respective areas, typically groups of "densely spaced" conductors are provided, while in the "intermediary space", (essentially) no conductors are arranged. Although a different design is possible, it is usually preferred, if different groups of conductors are powered by different power sources.

It is even further preferred, if in the magnetic field generating device the conductors, in particular the groups of conductors are designed and arranged in a way to serve a different purpose, in particular in a way that at least a first fraction of the conductors (and/or a first fraction of group of conductors) is designed and arranged as steerer conductors and/or in a way that at least a second fraction of the conductors (and/or a second fraction of groups of conductors) is designed and arranged as septum conductors. This way, the particle beam can be guided in a particular flexible way, which is typically advantageous. In particular, septum conductors will help in the separation of the injected/extracted particle beam with respect to the circulating particle beam, while steerer conductors will guide the particle beam towards it designated/intended flight path.

Another possible design of the magnetic field generating device is achieved if the electric conductors are at least partially neighboring the magnetic yoke device, preferably within at least said first angular range. This way, the magnetic yoke device can be particularly effective, in particular with respect to an "amplification" of the magnetic field and/or with respect to the quality of the resulting magnetic field.

First experiments have shown that it is preferred for the magnetic field generating device, if said first angular range has a size of up to approximately, of up to approximately 250° and/or of up to approximately 300°. However, different angles are possible as well. Other "upper limits" include (without limitation) 180°, 190°, 210°, 220°, 230°, 240°, 260°, 270°, 280°, 290°, 310°, 320° and/or 330°. Additionally or alternatively, the first angular range can show a minimum value as well, in particular an angle of more than (or equal to) 5°, 10°, 15°, 20°, 25°, 30°, 35°, 40°, 49°, 50°, 55°, 60°, 65°, 70°, 75°, 80°, 85°, 90°, 100°, 110°, 120°, 130°, 140°, 150°, 160°, 170° and/or 180°. Additionally and/or alternatively, a minimum value of an "angular range" can be defined by the number of (relevant) electric conductors. As an example, the "angular range" of the first angular range should be at least 3 electric conductors or more (or additionally or alternatively 4, 5, 6, 7, 8, 9, 10, 11, 12, 13, 14, 15, 20. 25, 30, 40, 45, 50 or more). If some of the electric conductors are arranged as stacks, the numbers given can be increased accordingly (as an example, if always two electric conductors are placed on top of each other, the indicated numbers of the individual electric conductors are consequently doubled). In case the electric conductors do not have a circular cross-section, the arrangement. (in particular a tilting) of the cross-sections can be taken into account when "designating" them to an "angular range" (this way, two electric conductors that are tilted by some angle with respect to each other are typically not considered Jo be arranged along a straight line, for example).

The above described minimum and/or maximum angle (possibly including the reference to the number of conductors) can preferably be applied to the second angular range as well. Preferably (although not necessarily required), the values of the angles are to be understood in the "reference frame" of the first angular range.

It is possible for the magnetic field generating device that the electric conductors are at least in part arranged as a single layer, as a double layer and/or or as stacked layers. The stacked layers can comprise of several layers, like 3, 4, 5, 6, 7, 8, 9, 10 or even more layers of conductors. This way, a particularly compact design of the resulting magnetic field generating device can be achieved. Furthermore, it is even possible that the quality and/or the strength of the resulting magnetic field can be improved as well.

In particular, the magnetic field generating device can be designed and arranged in a way that in at least a first section of the magnetic field generating device, a magnetic field with a low intensity is present, and/or in at least a second section of the magnetic field generating device, a magnetic field with a high intensity is present. In particular, a magnetic field with a high intensity can be larger than 0.5 Tesla, 0.75 Tesla, 1 Tesla, 1.25 Tesla, 1.5 Tesla, or 1.75 Tesla. On the contrary, a magnetic field with a low intensity can have a magnetic field strength of up to 0.05 Tesla, 0.075 Tesla or 0.1 Tesla. Using such a design, the resulting magnetic field generating device is particularly suited to be used as a septum magnet. In particular, the magnetic field with the high intensity can be used for the injected/extracted particle beam, while the magnetic field with the low intensity can be used for the circulating beam, or vice versa.

It is further suggested to. provide a magnetic switch arrangement for particle beam accelerators, comprising at least one magnetic field generating device according to the previous description and at least one kicker magnet device. This way, a particular well-suited injection unit/extraction unit for particle beams into and out of a circular accelerator (for example synchrotron) can be provided. Furthermore, a particle beam accelerator, in particular a. circular particle beam accelerator, is suggested, comprising at least one magnetic switch arrangement for particle beam accelerators and/or at least one magnetic field generating device according to the previous description.

In FIG. 1, a first possible embodiment of a septum magnet 1 is shown in a schematic cross-section. The cross-section is chosen to be perpendicular to the longitudinal axis of the septum magnet 1 (see also FIG. 2). The septum magnet 1 consists of a solid magnetic yoke, which is presently designed as an iron yoke 2. The iron yoke 2 comprises two inner cavities 3, 4, namely an extraction beam cavity 3 and the circular beam cavity 4. The extraction beam cavity 3 is used when an ion beam (more precisely an ion beam bunch) has to be extracted from the circular accelerator. If the ion beam has to continue circling through the circular accelerator, however, the circular beam cavity 4 will be used for the ion beam. As it is usual with accelerator facilities, both cavities 3, 4 are in an ultra high vacuum state (sometimes even in an extra high vacuum state). For evacuating the cavities 3, 4, suitable pumps like turbopumps or cryopumps are used.

In the presently shown embodiment of the septum magnet 1, the two cavities 3, 4 are separated by a thin iron wall 5 which is presently made of the same material as the iron yoke 2 itself. To give a rough estimate of the dimensions of the iron yoke 2: the thick parts of the iron yoke 2 are presently 8 cm thick with a total width of 33 cm and a total height of 38.5 cm of the septum magnet 1. The diameter of the extraction beam cavity 3 is 17 cm, the dimensions of the circular beam cavity 4 are 13.5 cm×6.5 cm. The thickness of the iron wall 5 is presently 0.5 cm, but there is an increase along the longitudinal axis of the septum magnet 1.

As can be seen from FIG. 1, inside of the extraction beam chamber 3, neighboring the inner wall of iron yoke 2, a plurality of groups of conductors 6*a*, 6*b*, 7*a*, 7*b* are arranged. On the upper side 6*a* and the lower side 6*b* of the extraction beam cavity 3 (directions according to FIG. 1), two groups of septum conductors 6*a*, 6*b* are arranged. To be able to use a sufficiently high magnetic field, the septum conductors 6*a*, 6*b* are arranged in two layers in the present example. Of course, it is also possible to use only a single layer or on the contrary three and even more layers of septum conductors 6. The resulting magnetic field $B_{sep}$ and the resulting Force $F_{sep}$ is indicated in FIG. 1.

On the left and the right side of the extraction chamber 3, another group of conductors 7 is arranged, namely so-called steerer conductors 7*a*, 7*b*. These conductors are used to steer the extracted ion beam to the left and to the right. This way, the position of the ion beam can be held in the middle of the extraction beam cavity 3 (of course, the electric current through the septum conductors 6*a*, 6*b* can be varied as well). The magnetic field $B_{ST}$ and the resulting Force $F_{ST}$ is indicated in FIG. 1 as well. As it is usual with particle accelerators, the magnetic field used for the septum bending direction has to be significantly larger as compared to the magnetic field of the steerer part of the septum magnet 1. Therefore, it is sufficient that the steerer conductors 7*a*, 7*b* are arranged as only a single layer and are less numerous as compared to the septum conductors 6*a*, 6*b*.

Furthermore, it can be seen from FIG. 1 that a part of the septum conductors 6*a* (and preferably even 6*b*) and the steerer conductors 7*a*, 7*b* are arranged along a circular. arc 8. Likewise, the extraction beam cavity 3 is formed like a circle in this area as well. In the lower part of the septum magnet 1, however, the septum conductors 6 are arranged along a truncation line 9 which is presently a straight line. The truncation line 9 has to follow a magnet field line that would be present, if all of the conductors 6*a*, 6*b* of the septum Conductor type would be arranged along a circular arc 8 that is undisturbed by the truncation line 9.

Using this arrangement of the conductors 6*a*, 6*b*, 7*a*, 7*b*, it is possible to create a very high magnetic field within the extraction beam cavity 3 of the septum magnet 1, which is presently 1.85 Tesla. At the same time, the magnetic field in the circular beam cavity 4 is very low and is as low as 3 mT and less in the presently shown embodiment.

Figure 2:
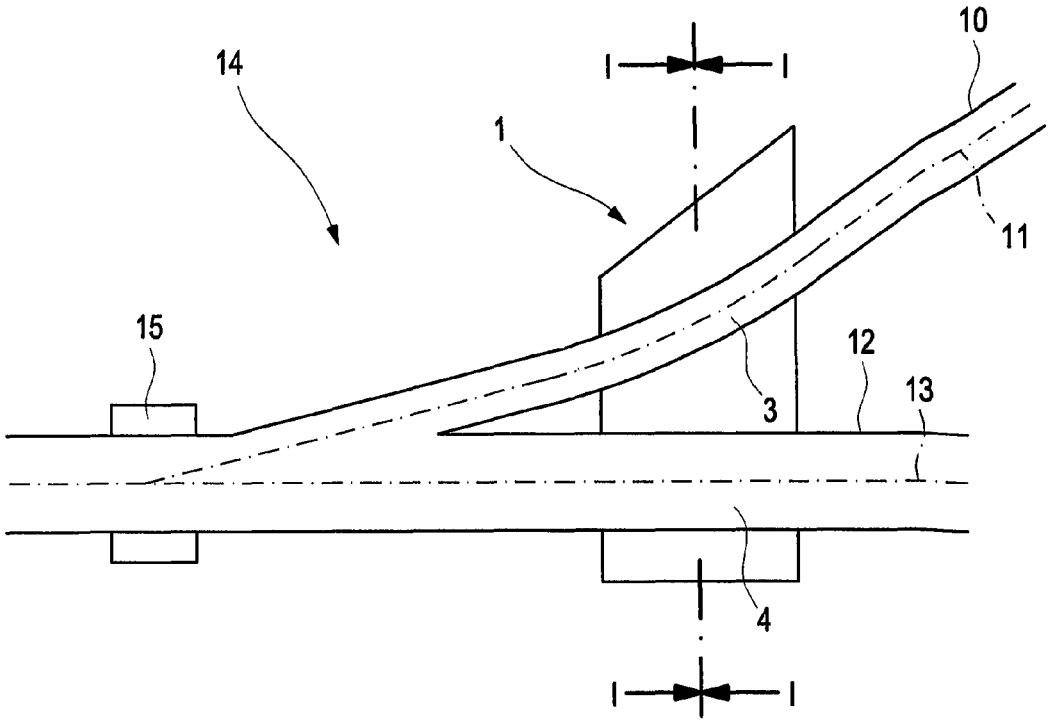
FIG. 2 shows an embodiment of a particle switch beam comprising a kicker magnet and a septum magnet in a schematic view from above.

In FIG. 2, the septum magnet 1 is shown in a schematic view from above. The extraction beam cavity 3 (which is connected to an appropriate extraction beam line 10 for guiding the extracted beam 11) is indicated. Similarly, a circular beam line 12 for guiding the circular beam 13 (indicated as a dashed line) is indicated in FIG. 2. It has to be noted that FIG. 2 shows only a small part of a circular accelerator so that the circular beam 13 and the circular beam line 12 will be closed, forming a closed loop outside of FIG. 2. However, it is of course possible that the septum magnet 1 is used in a linear accelerator, as well (for example as a particle switch for switching quickly between two experiments).

The septum magnet 1 forms part of an extraction arrangement 14. Another part of the extraction arrangement 14 is a so-called•kicker magnet 15 which is as such known in the state of the art. The kicker magnet 15 can be magnetized and de-magnetized within a very short time, typically within 0.1 μs. If 5 the kicker magnet 15 is energized, the incoming particle beam will be bent towards the extraction beam cavity 3 of the septum magnet 1 (indicated by a dash dotted line 11), where it is further bent outward towq.rds other equipment (for example an experiment; presently not shown). If the kicker magnet 15 is de-energized, however, the particle beam will remain a circular beam 13 (indicated by a dashed line) that will penetrate the circular beam cavity 4 of the septum magnet 2.

The two very basic design parameters of the presently suggested septum magnet 1, i.e. conductors 6*a*, 7*a*, 7*b* that are arranged along a part of a circular line 8 and which are neighboring an iron yoke 2, and a truncation part 9, where conductors 6*a* are arranged along a truncation line 9 that is usually following the direction of the magnetic field lines which would be present, if the conductors would be arranged along a closed circle line, can be fulfilled by a plurality of different designs. A couple of possible designs, fulfilling these basic conditions, is shown in FIG. 3.

Figure 3:
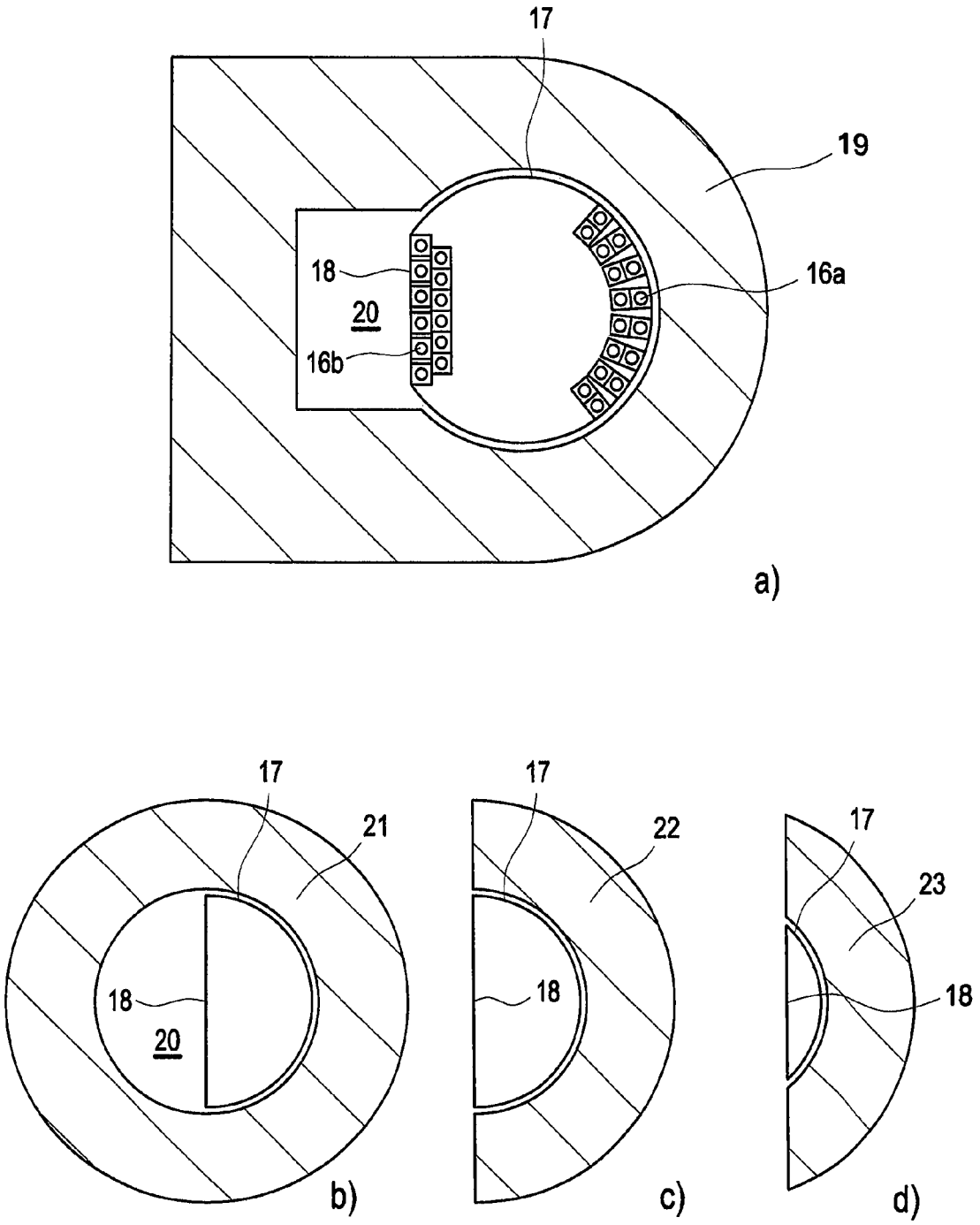
FIG. 3 shows different embodiments of dipole septum magnets without an iron screen, each in a schematic cross-section.

For example, in FIG. 3, conductors 16*a*, 16*b* are arranged along a truncated circle line 17 with a straight part 18. The conductors 16*a*, 16*b* are enclosed by an iron yoke 19, where the iron yoke 19 is designed in a way that it is directly neighboring the conductors 16*a* that are lying on the circular part of the truncated circle line 17. In the vicinity of the conductors 16*b* that are arranged along the straight part 18 of the truncated circle line 17, an enlarged cavity 20 is foreseen in the iron yoke 19. However, no iron wall or the like is placed within the inner cavity of the iron yoke 19.

As it is shown in FIG. 3*b*, the truncated circle line 17 (more exactly, the electric conductors 16*b* that are placed along the truncated circle line 17; presently not shown) can be arranged together with a differently shaped iron yoke 21 as well. In the presently shown example of FIG. 3*b*, the iron yoke 21 is designed as a circular iron yoke 21. Even with the presently shown embodiment of iron yoke 21, the conductors 16*a* that are arranged along the circular arc part of the truncated circle line 17 are directly neighboring the iron yoke 21, while an enlarged cavity 20 is formed by the iron yoke 21 outside of the straight part 18 of the truncated circle line 17.

It has to be noted that it is not even necessary to design the iron yoke as a closed iron yoke (as it is done in the embodiments of FIG. 3*a* and FIG. 3*b*). Instead, even an open iron yoke 22, 23 can be used, as it shown in the embodiments of FIG. 3*c* and FIG. 3*d*. Although it is an open yoke 22, 23, the iron yoke 22, 23 is still directly neighboring the circular part of the truncated circle line 17, as can be seen from FIG. 3*c* and FIG. 3*d*.

The main difference between FIG. 3*c* and FIG. 3*d* is the (angular) size of the circular part and the size (and the position) of the straight part of the truncated circle line 17. Nevertheless, despite of this very reduced design, a magnetic field that is comparatively strong and homogenous inside the truncated circle line 17 and a comparatively low (and homogenous) magnetic field outside of the truncated circle line 17 can be achieved.

Figure 4:
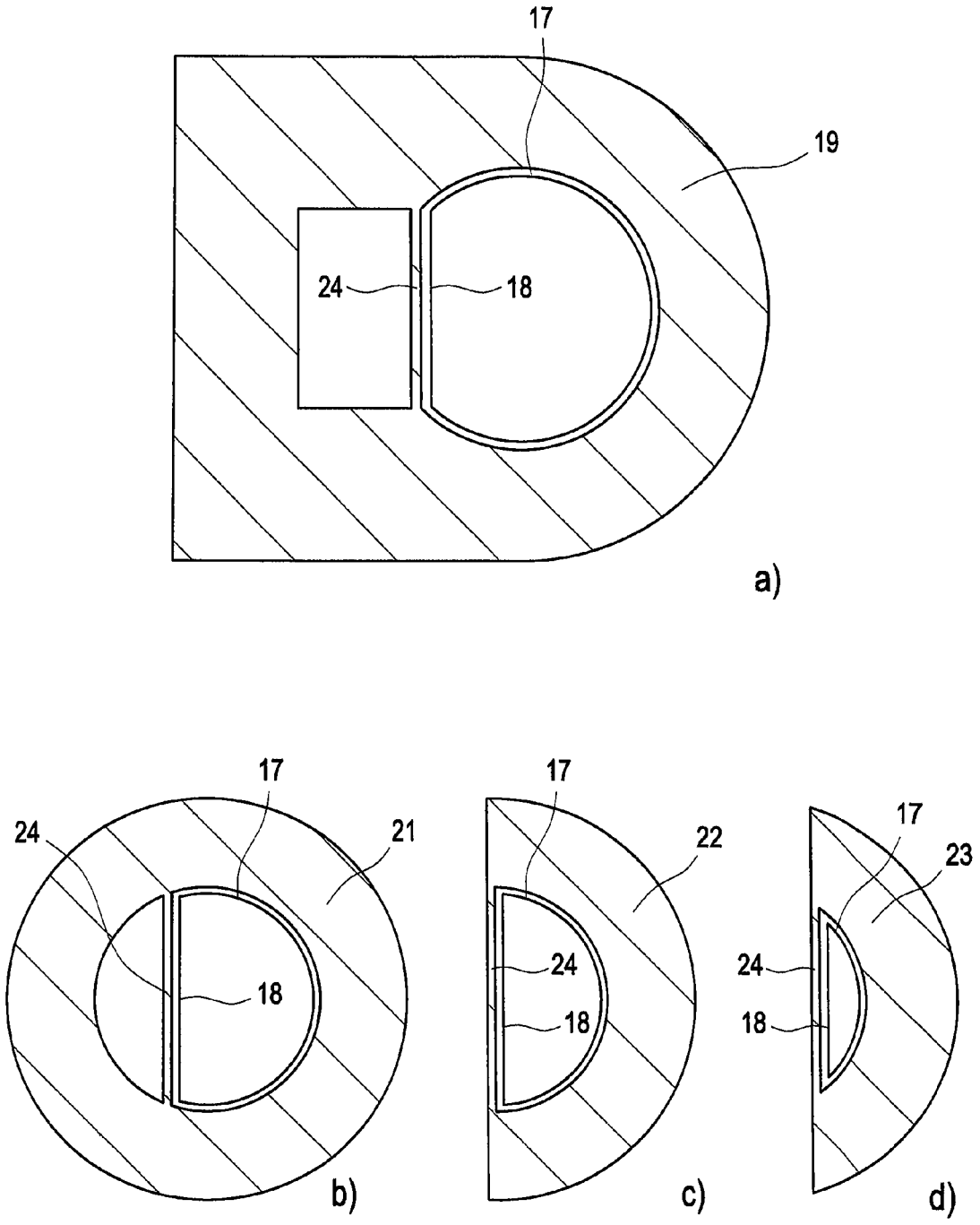
FIG. 4 shows different embodiments of dipole septum magnets with an iron screen, each in a schematic cross-section.

In FIG. 4 the embodiment of FIG. 3 is shown once again. However, this time an iron screen 24 (a thin metal wall, made of iron) is arranged neighboring the straight part 18 of the truncated circle line 17. First experiments have indicated that when providing such an iron screen 24, the resulting magnetic field distribution can be improved over the embodiments, shown in FIG. 3.

While in the presently shown examples according to FIGS. 1 to 4, a dipole has been considered, it is likewise possible to consider a quadrupole. This is shown in FIGS. 5 and 6.

In FIGS. 5*a* through 5*d*, examples that are very similar to the embodiments of FIG. 3 are shown. In particular, an iron yoke 19, 21, 25 is used that is neighboring conductors 26*a*, 26*b*, 26*c* that are arranged along a circular part 28 of a truncated circle line 27. Since this is a quadrupole, altogether four groups of conductors 26*a*, 26*b*, 26*c*, 26*d* are provided. In the circular part 28 of the truncated circle line 27, however, only three groups of electric conductors 26*a*, 26*b*, 26*c* are arranged. On the curved line side 29 of the truncated circle line 27, a fourth group of conductors 26*d* is arranged. Since a regular quadrupole would provide a magnetic field pattern with inwardly directed hyperbolae, the curved line 29 of the truncated circle line 27 is consequently following an inwardly directed hyperbola. Likewise the conductors 26*d* of the force group of conductors 26 are following this curved line 29.

Similar to the dipole case, even in the quadrupole case, no iron yoke 19, 21, 25 is necessary in close vicinity of the curved line part 29 of the truncated circle line 27 (or even no yoke part is necessary at all in this area; see iron yoke 25—FIG. 5*b*). Nevertheless, inside of the truncated circle line 27, a strong magnetic (quadrupole) field will be present, while outside of the truncated circle line 27, a very small magnetic field will remain. In FIG. 5*d*, another possible shape of the truncated circle line 30 is shown that has two circular parts 28 and two (inwardly directed) curved lines 29 that are following the magnetic field lines of an "undisturbed" magnetic quadrupole field.

Figure 5:
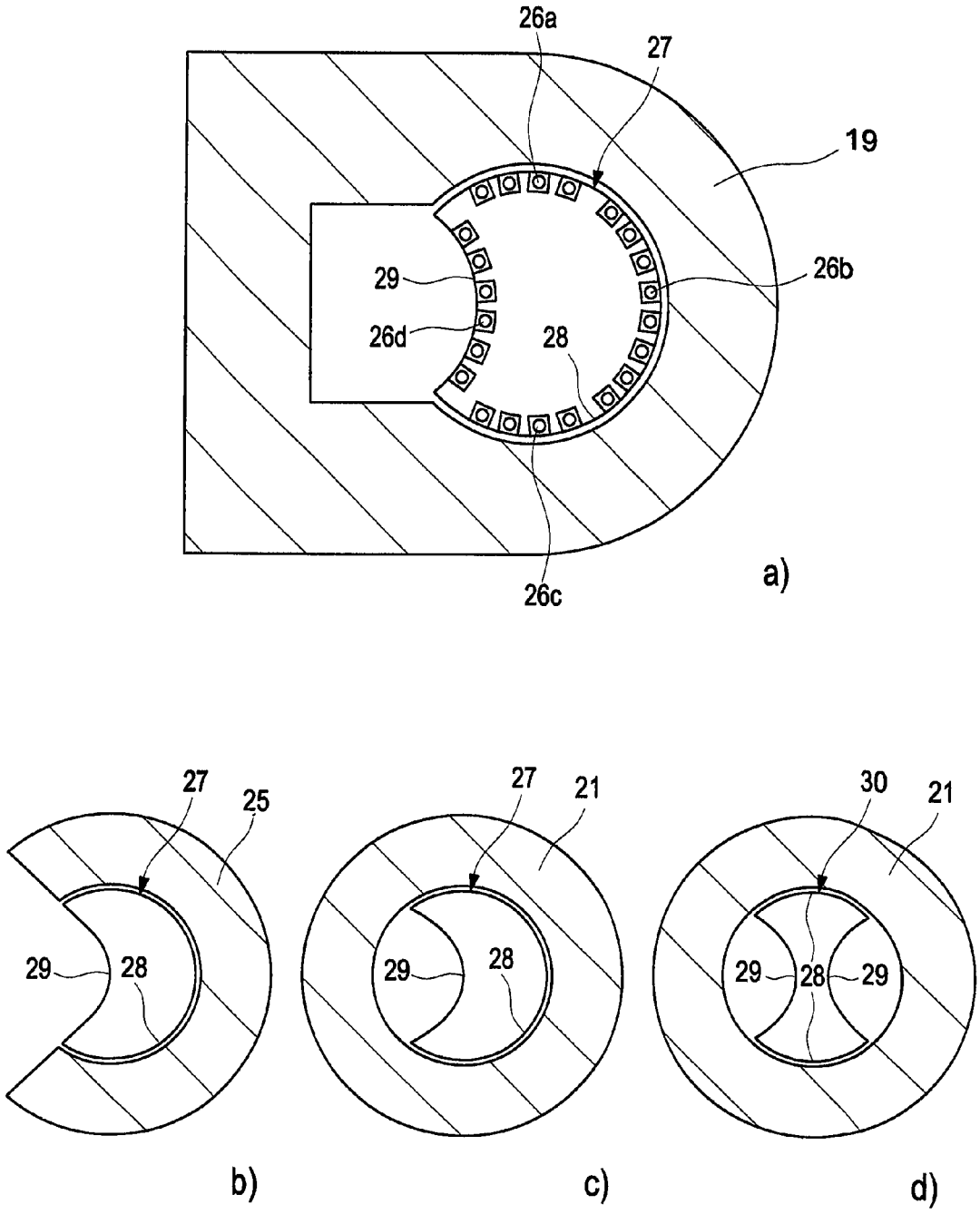
FIG. 5 shows different embodiments of quadrupole septum magnets without a screen, each in a schematic cross-section.
Figure 6:
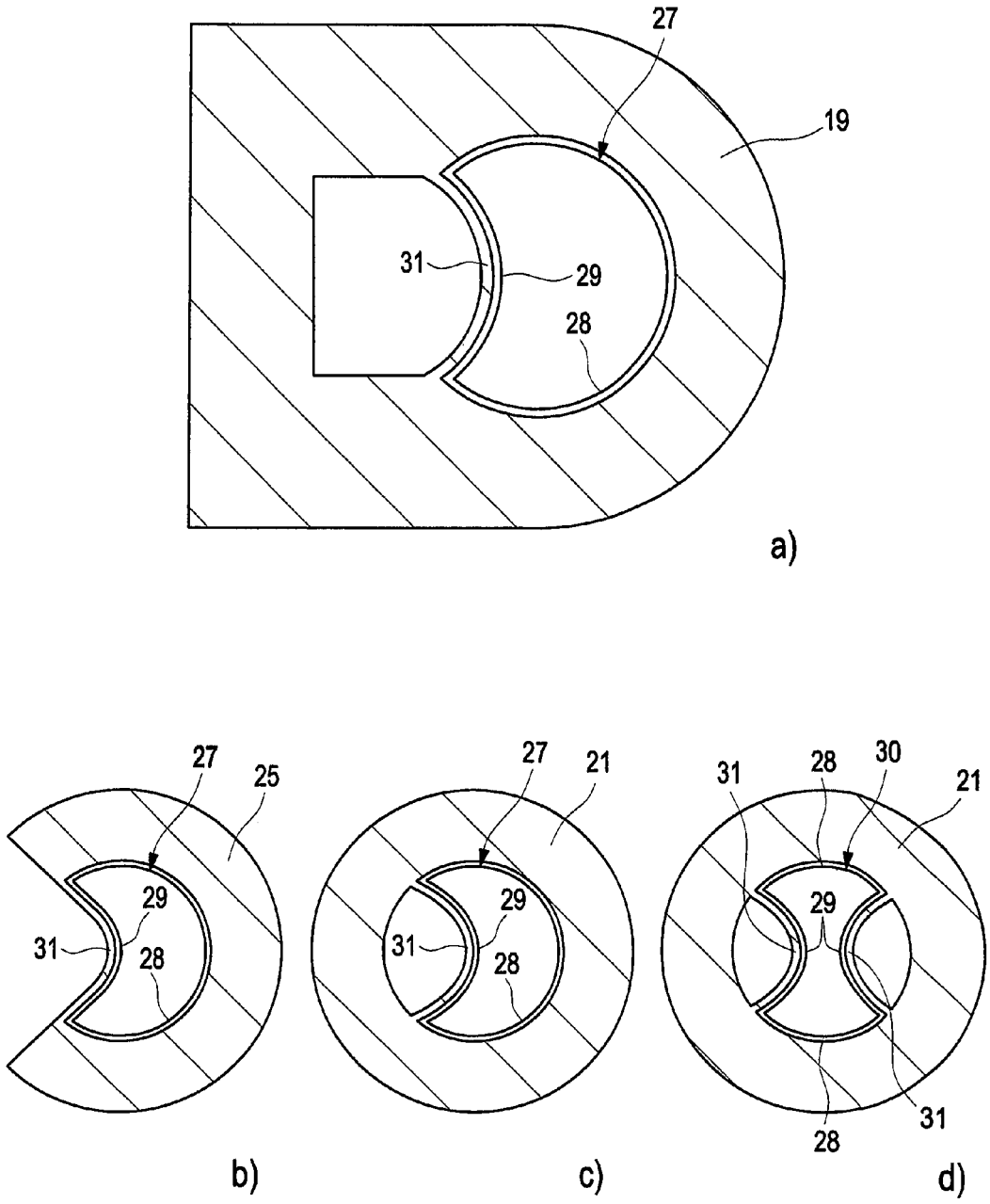
FIG. 6 shows different embodiments of quadrupole septum magnets with an iron screen, each in a schematic cross-section.

In FIG. 6 essentially the same arrangements as in FIG. 5 are shown. However, close to the curved line(s) 29 of the truncated circle lines 27, 30, an appropriately shaped iron shield 31 is provided (respectively).

Figure 7:
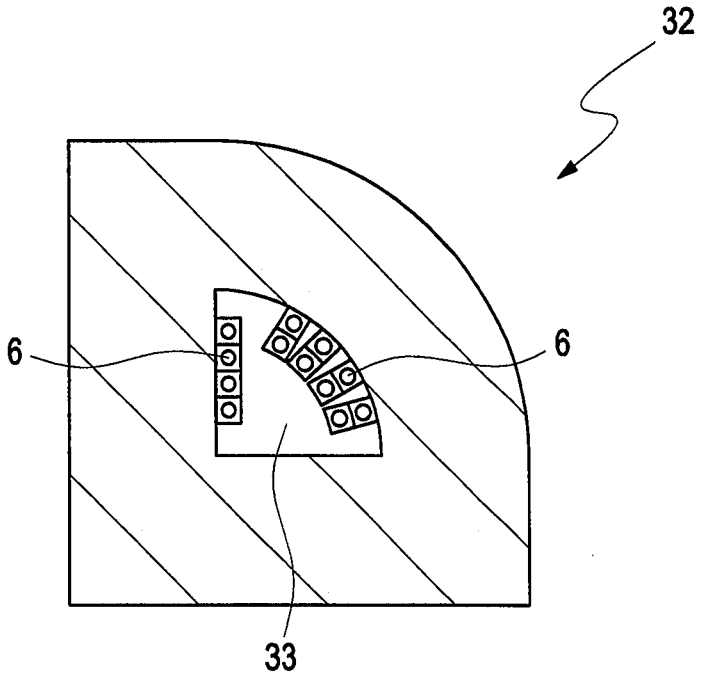
FIG. 7 shows a schematic cross-section of a single quadrant dipole septum magnet.

In FIG. 7, finally, another embodiment of a septum magnet 32 is shown. In the presently shown embodiment of a septum magnet 32, only a single quadrant 33 of a full circle is used. The arrangement of the septum conductors 6 (in the presently shown example two layers on one side and one layer on the other side) is shown in FIG. 7. Even in the presently shown, a very simple design of a septum magnet 2, within a single quadrant 33, a strong, comparatively homogenous magnetic field can be achieved, while outside of the quadrant 33, a very small and homogenous magnetic field will result.

Just as a matter of completeness: the septum magnet 32, shown in FIG. 7, only comprises septum conductors 6, and no steerer conductors.

While the invention has been illustrated and described in detail in the drawings and foregoing description, such illustration and description are to be considered illustrative or exemplary and not restrictive. It will be understood that changes and modifications may be made by those of ordinary skill within the scope of the following claims. In particular, the present invention covers further embodiments with any combination of features from different embodiments described above and below.

The terms used in the claims should be construed to have the broadest reasonable interpretation consistent with the foregoing description. For example, the use of the article "a" or "the" in introducing an element should not be interpreted as being exclusive of a plurality of elements. Likewise, the recitation of "or" should be interpreted as being inclusive, such that the recitation of "A or B" is not exclusive of "A and B," unless it is clear from the context or the foregoing description that only one of A and B is intended. Further, the recitation of "at least one of A, B and C" should be interpreted as one or more of a group of elements consisting of A, B and C, and should not be interpreted as requiring at least one of each of the listed elements A, B and C, regardless of whether A, B and C are related as categories or otherwise. Moreover, the recitation of "A, B and/or C" or "at least one of A, B or C" should be interpreted as including any singular entity from the listed elements, e.g., A, any subset from the listed elements, e.g., A and B, or the entire list of elements A, B and C.

REFERENCE SYMBOL LIST

1. Septum Magnet
2. Iron Yoke
3. Extraction Beam Cavity
4. Circular Beam Cavity
5. Iron Wall
6*a*,6*b* Septum Conductor
7*a*, 7*b* Steerer Conductor
8. Circular Arc
9. Truncation Line
10. Extraction Beam Line
11. Extracted Beam
12. Circular Beam Line
13. Circular Beam
14. Extraction Arrangement
15. Kicker Magnet
16. Conductor
17. Truncated Circle Line
18. Straight Power
19. Iron Yoke
20. Enlarged Cavity
21. Iron Yoke
22. Open Iron Yoke
23. Open Iron Yoke
24. Iron Screen
25. Iron Yoke
26. Conductor
27. Truncated Circle Line
28. Circular Part
29. Curved Line
30. Truncated Circle Line
31. Iron Shield
32. Septum Magnet
33. Quadrant

The invention claimed is:

1. A device for generating a magnetic field comprising:

at least one electric coil device including electric conductors arranged, in at least one cross-section of the at least one electric coil device, along a circular arc within a first angular range and deviating from the circular arc within a second angular range; and at least one magnetic yoke arranged along at least a part of the first angular range, wherein the at least one magnetic yoke includes a first channel section arranged inside of the at least one electric coil device and a second channel section arranged outside of the at least one electric coil device, the first and second channel sections being configured to convey a particle beam.

2. The device for generating a magnetic field of claim 1, wherein the at least one magnetic yoke device is arranged along an entirety of the first angular range.

3. The device for generating a magnetic field of claim 1, wherein the at least one magnetic yoke is a closed magnetic yoke.

4. The device for generating a magnetic field of claim 1, wherein the at least one magnetic yoke includes a magnetic yoke wall disposed between the first channel section and the second channel section.

5. The device for generating a magnetic field of claim 1, wherein the at least one magnetic yoke includes at least one of a ferromagnetic material or a portion including stacked sheet layers.

6. The device for generating a magnetic field of claim 1, wherein the at least one electric coil device is a tubular electric coil device.

7. The device for generating a magnetic field of claim 1, wherein the cross section is essentially perpendicular to a longitudinal axis of the at least one electric coil device.

8. The device for generating a magnetic field of claim 1, wherein at least a part of the electrical conductors is tilted with respect to at least one of a plane of the at least one cross-section or a main axis of the at least one electric coil device, and wherein at least a part of the electrical conductors are at least one of arranged as cosine theta magnet windings or arranged as cosine n-times theta magnet windings.

9. The device for generating a magnetic field of claim 1, wherein the electrical conductors within the second angular range are at least one of arranged along a straight line or arranged along a curved line.

10. The device for generating a magnetic field of claim 9, wherein the electrical conductors within the second angular range are arranged along the magnetic field lines produced by electrical conductors arranged along a fully circular line.

11. The device for generating a magnetic field of claim 1, wherein the electrical conductors are arranged in groups that are spaced from one another.

12. The device for generating a magnetic field of claim 11, wherein the electrical conductors include a first group of electrical conductors arranged to serve as steerer conductors, and a second group of electrical conductors arranged to serve as septum conductors.

13. The device for generating a magnetic field of claim 1, wherein the electrical conductors at least partially neighbor the magnetic yoke device.

14. The device for generating a magnetic field of claim 1, wherein the first angular range is less than or equal to 200°.

15. The device for generating a magnetic field of claim 1, wherein the first angular range is less than or equal to 250°.

16. The device for generating a magnetic field of claim 1, wherein the first angular range is less than or equal to 300°.

17. The device for generating a magnetic field of claim 1, wherein at least a portion of the electrical conductors are arranged as one or more of: a single layer, a double later, or a stacked layer.

18. The device for generating a magnetic field of claim 1, wherein:

a first section of the device has a low intensity magnetic field; and a second section of the device has a high intensity magnetic field.

19. The device for generating a magnetic field of claim 1, wherein the at least one magnetic yoke includes a metal wall disposed between the first channel section and the second channel section.

20. The device for generating a magnetic field of claim 1, wherein the first channel section and the second channel section are each evacuated so as to contain a vacuum.

21. A magnetic switch apparatus for a particle beam accelerator comprising:

a kicker magnet device; and a device for generating a magnetic field including:

at least one electric coil device including electric conductors arranged, in at least one cross-section of the at least one electric coil device, along a circular arc within a first angular range and deviating from the circular arc within a second angular range; and at least one magnetic yoke arranged along at least a part of the first angular range.

* * * * *